US011844738B2

(12) United States Patent
Bruesewitz

(10) Patent No.: US 11,844,738 B2
(45) Date of Patent: Dec. 19, 2023

(54) THERAPY DEVICE FOR NECK AND SPINE

(71) Applicant: Troy Bruesewitz, Burlington, WI (US)

(72) Inventor: Troy Bruesewitz, Burlington, WI (US)

( * ) Notice: Subject to any disclaimer, the term of this patent is extended or adjusted under 35 U.S.C. 154(b) by 1045 days.

(21) Appl. No.: 16/542,425

(22) Filed: Aug. 16, 2019

(65) Prior Publication Data

US 2020/0054515 A1 Feb. 20, 2020

Related U.S. Application Data

(60) Provisional application No. 62/719,339, filed on Aug. 17, 2018.

(51) Int. Cl.
*A61H 1/02* (2006.01)

(52) U.S. Cl.
CPC ... *A61H 1/0296* (2013.01); *A61H 2201/0157* (2013.01); *A61H 2201/1604* (2013.01); *A61H 2203/0456* (2013.01); *A61H 2205/04* (2013.01)

(58) Field of Classification Search
CPC ..... A61H 1/0296; A61H 1/00; A61H 1/0292; A61H 1/0229; A61H 1/0218; A61H 1/0222; A61H 1/0274; A61H 1/02; A61H 11/00; A61H 11/02; A61H 2201/0157; A61H 2201/1604; A61H 2201/0107; A61H 2201/0161; A61H 2201/1207; A61H 2201/1614; A61H 2201/1609; A61H 2203/0456; A61H 2205/04; A61F 5/04; Y10S 482/907; A61G 7/072; A61G 7/1084; A63B 21/4003; A63B 23/025
See application file for complete search history.

(56) References Cited

U.S. PATENT DOCUMENTS

| | | | | |
|---|---|---|---|---|
| X806565 | | 12/1905 | Percy | |
| 1,265,083 | A | 5/1918 | Hoard | |
| 1,314,002 | A * | 8/1919 | Lee | A61H 1/0218 602/33 |
| 1,855,408 | A | 4/1932 | Montenegro | |
| 2,290,407 | A | 7/1942 | Collins | |
| 2,701,564 | A | 2/1955 | Wilhelm | |
| 3,221,735 | A * | 12/1965 | Goodman | A61H 1/0218 D24/188 |

(Continued)

FOREIGN PATENT DOCUMENTS

| | | |
|---|---|---|
| GB | 2138689 | 10/1984 |
| WO | 2011101846 | 8/2011 |

*Primary Examiner* — Justine R Yu
*Assistant Examiner* — Kelsey E Baller
(74) *Attorney, Agent, or Firm* — Boyle Fredrickson, S.C.

(57) ABSTRACT

A therapy device includes a frame, a motor, and a sling on which a neck of a supine user rests. The sling is movable by the motor relative to the frame to enable continuous passive motion rotation of a user's neck and cervical spine. Additionally, depending on where the user's head is placed relative to the sling, the user's spine can be placed in axial traction, and the user's neck can also be placed into extension. Movement of the sling may be achieved by an armature that is rotated by the motor. The armature may include a plurality of openings formed therein that are configured to receive a sling lead. Each of the openings results in a different amount of rotational movement of the user's head, such that a user can adjust to location of the sling pin to result in a desired amount of rotational movement.

2 Claims, 9 Drawing Sheets

(56) References Cited

U.S. PATENT DOCUMENTS 3,381,683 A * 5/1968 Runde ..... A61H 11/00 D28/40
3,472,222 A 10/1969 Aplin
3,654,922 A * 4/1972 Outcalt ..... A63B 21/1663 D24/188
4,649,905 A 3/1987 Barnes
4,723,537 A 2/1988 Parker, Jr.
4,724,828 A 2/1988 Barnes et al.
4,956,881 A 9/1990 Lindley et al.
4,971,043 A * 11/1990 Jones ..... A61H 1/0218 602/36
5,137,015 A * 8/1992 Anglehart ..... A61H 1/0296 601/84
5,320,640 A 6/1994 Riddle et al.
5,467,490 A 11/1995 Rice
5,498,218 A 3/1996 Proctor et al.
5,569,175 A 10/1996 Chitwood
6,263,526 B1 7/2001 Tu
6,460,207 B1 10/2002 Papay et al.
6,517,506 B1 2/2003 Pettibon
6,599,257 B2 7/2003 Al-Obaidi et al.
6,692,451 B2 2/2004 Splane, Jr.
6,945,986 B2 9/2005 Lope
7,048,700 B1 * 5/2006 Gustie ..... A61H 1/0296 601/39
7,430,733 B1 9/2008 Yaari
8,216,248 B2 7/2012 Brown et al.
8,323,223 B1 12/2012 Woggon et al.
8,485,195 B2 7/2013 River et al.
8,523,743 B1 * 9/2013 Miles ..... A63B 23/03508 482/142
8,613,690 B1 12/2013 Thompson
9,468,578 B2 10/2016 Bonutti et al.
9,707,147 B2 7/2017 Levital et al.
9,901,505 B2 2/2018 Bombard
2007/0117698 A1 5/2007 Adamson
2009/0204039 A1 8/2009 Elan et al.
2011/0178450 A1 7/2011 Mackowiak
2012/0253241 A1 10/2012 Levital et al.
2014/0249461 A1 * 9/2014 Bissell ..... A61H 1/0218 602/36
2014/0303527 A1 10/2014 Bonutti et al.
2016/0346146 A1 * 12/2016 O'Loughlin ..... A61H 1/0296
2019/0015237 A1 1/2019 Agrawal et al.
2019/0083349 A1 * 3/2019 Taves ..... A61H 1/0296

* cited by examiner

THERAPY DEVICE FOR NECK AND SPINE

CROSS-REFERENCE TO RELATED APPLICATION

The present application claims priority on U.S. Provisional Patent Application Ser. No. 62/719,339, filed Aug. 17, 2018 and entitled *Therapy Device for Neck and Spine*, the entirety of which is hereby incorporated herein by reference.

BACKGROUND OF THE INVENTION

1. Field of the Invention

The present invention relates generally to therapy devices and, more particularly, to a therapy device for a user's neck and spine. The invention also relates to an automated, motorized therapy device that results in continuous passive motion rotation of a supine or recumbent user's neck and spine. The invention additionally relates to a method of operating such a therapy device.

2. Discussion of the Related Art

An increasingly common medical issue is pain throughout an individual's neck and spine. These symptoms can result from physical activity or hereditary conditions such as degenerative cervical spine conditions including degenerative disc disease and spinal arthritis. Furthermore, spine issues are becoming more prevalent in light of current use of computers, Smartphones, tablets, and the like, which oftentimes cause a user to bend over or look downwardly for extended periods of time. These problems can be further exacerbated by poor posture, accidents such as automobile or sports accidents, and the like.

Oftentimes, users use neck massagers to attempt to relieve pain throughout the neck and spine. Unfortunately, traditional massagers fail to address or have a therapeutic effect on the spine itself, and only massage the soft tissue. This inadequacy may be due at least in part to the fact that traditional massagers are not equipped to move the spinal joints. This results in an inadequate or incomplete therapeutic result on the neck and spine.

It is well known that continuous passive motion exercises can be therapeutic. This type of motion is thought to be beneficial because it promotes nutrient transfer, which brings in fresh nutrients to joints while also washing away harmful toxins. Additionally, no continuous passive motion machines exist for the cervical spine, however axial traction and extension exercises of the user's neck have been shown to help encourage ideal cervical curve position. A machine that encompasses axial traction and extension as well as continuous passive motion is anticipated to be therapeutic above those that only provide axial traction and extension.

Various machines have been created to help with continuous passive motion exercises without the assistance of a doctor, chiropractor, or physical therapist. For instance, many machines that result in continuous passive motion are used following surgical procedures on shoulders and knees. These automated machines allow a user to receive the same health benefits associated with continuous passive motion exercises that are oftentimes supervised by a medical professional without requiring the user to pay costly medical bills or visit a medical facility. Additionally, these machines allow a user to do automated exercises from the comfort of his or her own home. Unfortunately, no such devices are currently available for a user's neck and cervical spine.

What is needed is a powered therapy device that provides continuous passive motion to a user's neck and cervical spine.

What is also needed is an automated therapy device that stimulates the muscles, soft tissues, and joints of the spine simultaneously using continuous passive motion rotation.

What is additionally needed is a therapy device that results in extension and axial traction during the rotation of the user's head, neck, and cervical spine.

What is further needed is a therapy device that can easily be used by users in the comfort of their own homes to relieve symptoms of neck and cervical spine conditions.

SUMMARY OF THE INVENTION

In accordance with an aspect of the invention, a therapy device that provides passive motion to a supine or recumbent user's neck and spine is provided. The device may include a frame and a sling that is movably connected to the frame so as to be capable of supporting the neck and head of a supine user, with the user's neck resting on the sling and his or her head extending beyond the sling. The device may also include a motor which is coupled to the sling so as to drive the sling to move relative to the frame in reciprocating manner in which opposite ends of the sling move oppositely one another. When the sling is driven by the motor to move relative to the frame, the user's spine experiences continuous passive motion rotation. For instance, movement of the sling may result in rotation of the user's head, neck, and cervical spine between 60 and 180 degrees.

The sling is configured to hold and support a portion of the user's neck and head. Depending on where the user's body is located relative to the sling, the user's neck may rest on the sling, and his or her head may extend beyond the sling in a downward direction so as to be supported on the sling without actually resting on the sling, which in turn results in axial traction of a portion of the user's cervical spine and extension of a portion of the user's neck.

According to another aspect of the invention, the frame may include a plurality of legs that are mounted to a housing. The housing may contain components that enable movement of the sling. For instance, the housing may include the motor, as well as an armature that may be rotated by the motor. For instance, the armature may have a base opening that is rotatably connected to a rotational shaft of the motor and a lateral arm that extends from the base opening. Rotation of the armature by the rotational shaft results in rotation of the patient's neck and spine. For instance, a sling lead may be releasably connected to the lateral arm, and a strap that is connected to the opposed ends of the sling may be releasably affixed to the sling lead. Thus, while the armature rotates, the strap also rotates. This causes opposed upward and downward movement of opposing ends of the sling.

A plurality of holes may be formed in the lateral arm, where the sling lead can be releasably insertable into any one of the plurality of holes. For instance, the lateral arm may have seven holes formed therein. When the sling lead is inserted into a first hole that is located directly adjacent to the base opening, the degree of rotation is minimized. When the sling lead is inserted into a second hole that is located adjacent to an end of the lateral arm, the degree to rotation is maximized. For instance, when the sling lead is inserted into the first hole, the degree of rotation may be approximately 60 degrees and when the sling lead is inserted into the second hole the degree of rotation may be approximately 180 degrees. Additionally, the frame may include legs with channels formed therein to accommodate the strap and enable to the strap to enter into the housing. Thus, rotation of the armature can result in movement of a first end and a second end of a strap associated with the sling in upward and downward directions. Each rotational cycle of the armature may be between six to twenty seconds. Additionally, the speed of motion of the sling may be variable.

According to another aspect of the invention, the sling includes a first side, a second side opposite the first side, a first end extending between the first side and the second side, and a second end opposite the first end. Additionally, the sling may include a first ring attached to the first end adjacent to the first side and a second ring attached to the second end adjacent to the first side. A first end of the strap may be attached to the first ring and a second end of the strap may be attached to the second ring. Additionally, the sling may have a channel formed along the second end with a drawstring threaded therethrough. Clamps may also be provided at either end of the drawstring to enable adjustability of the sling.

In accordance with another aspect of the invention, a method includes first resting a neck and head portion of a supine user on a sling having a first end and a second end. Thereafter, rotational movement may be supplied to the sling. This can include first moving the first end of the sling in an upward direction while moving the second end in a downward direction to cause rotation of the user's head in a first direction. Next, the first end of the sling may be moved in a downward direction and the second end may be moved in an upward direction to cause rotation of the user's head in a second direction. Additionally, a sling lead may be provided that is releasably inserted into a first opening in an armature. Next, a strap may be attached to both the sling and the sling lead. The sling lead may be releasably inserted into a number of openings formed in the armature that result in different rotational paths. For instance, when maximum rotation is desired, initially a user is in a resting position in which the user's head faces directly upwardly from the sling the head or neck can be rotated in a first direction approximately 90 degrees. After that, the head or neck can be rotated in a second direction approximately 180 degrees. The head can then be rotated back and forth approximately 180 degrees in the first direction and then the second direction.

In accordance with another aspect of the invention, a method includes first resting a neck and portion of a prone user on a sling having a first end and a second end. Thereafter, rotational movement may be supplied to the sling. This can include first moving the first end of the sling in an upward direction while moving the second end in a downward direction to cause rotation of the user's head in a first direction. Next, the first end of the sling may be moved in a downward direction and the second end may be moved in an upward direction to cause rotation of the user's head in a second direction. Additionally, a sling lead may be provided that is releasably inserted into a first opening in an armature. Next, a strap may be attached to both the sling and the sling lead. The sling lead may be releasably inserted into a number of openings formed in the armature that result in different rotational paths.

These and other aspects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof. It is hereby disclosed that the invention include all such modifications.

BRIEF DESCRIPTION OF THE DRAWINGS

Exemplary embodiments of the invention are illustrated in the accompanying drawings in which like reference numerals represent like parts throughout, and in which.

DETAILED DESCRIPTION OF THE PREFERRED EMBODIMENT

Figure 1:
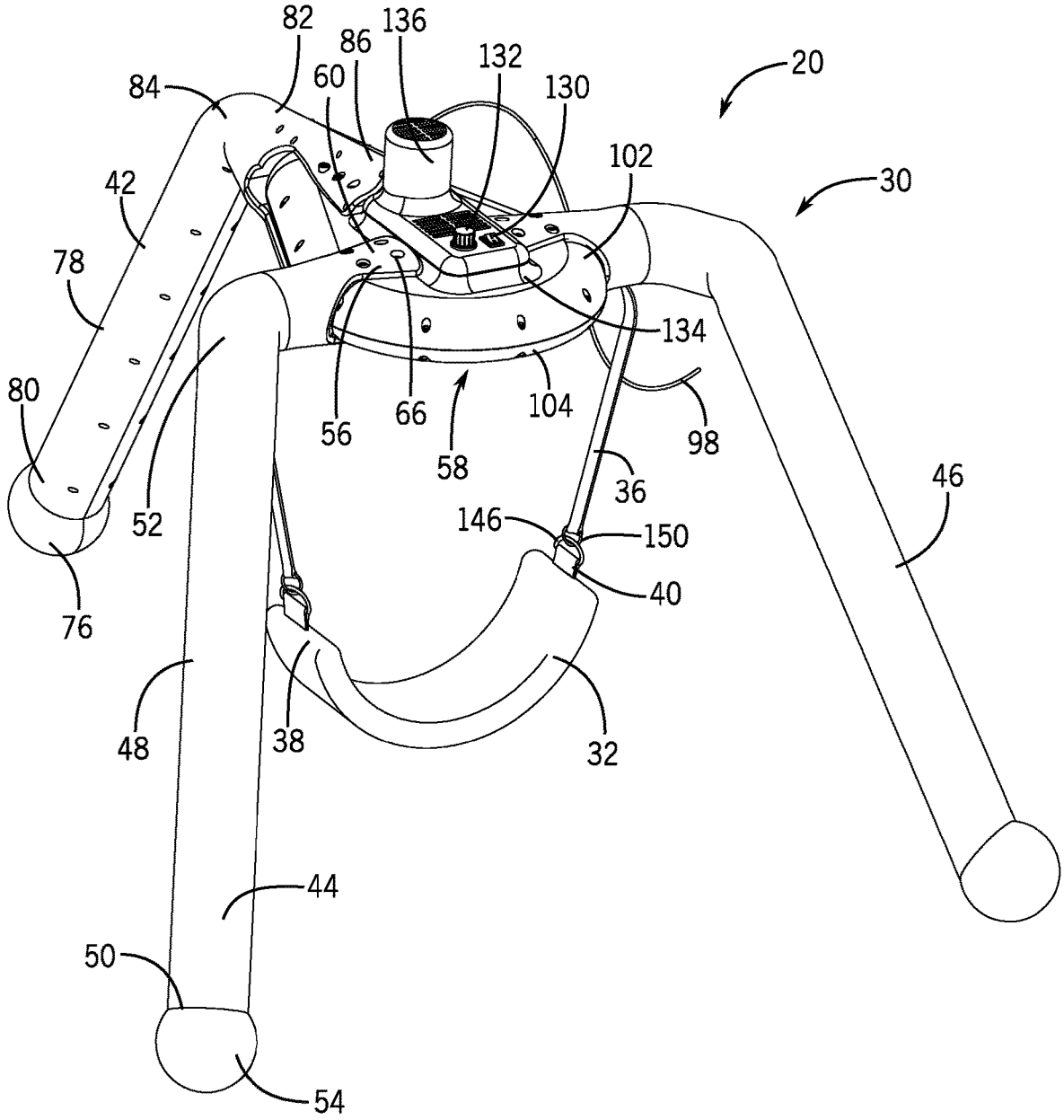
FIG. 1 is an isometric a therapy device for a neck and spine that rotates a user's head from side to side.
Figure 2:
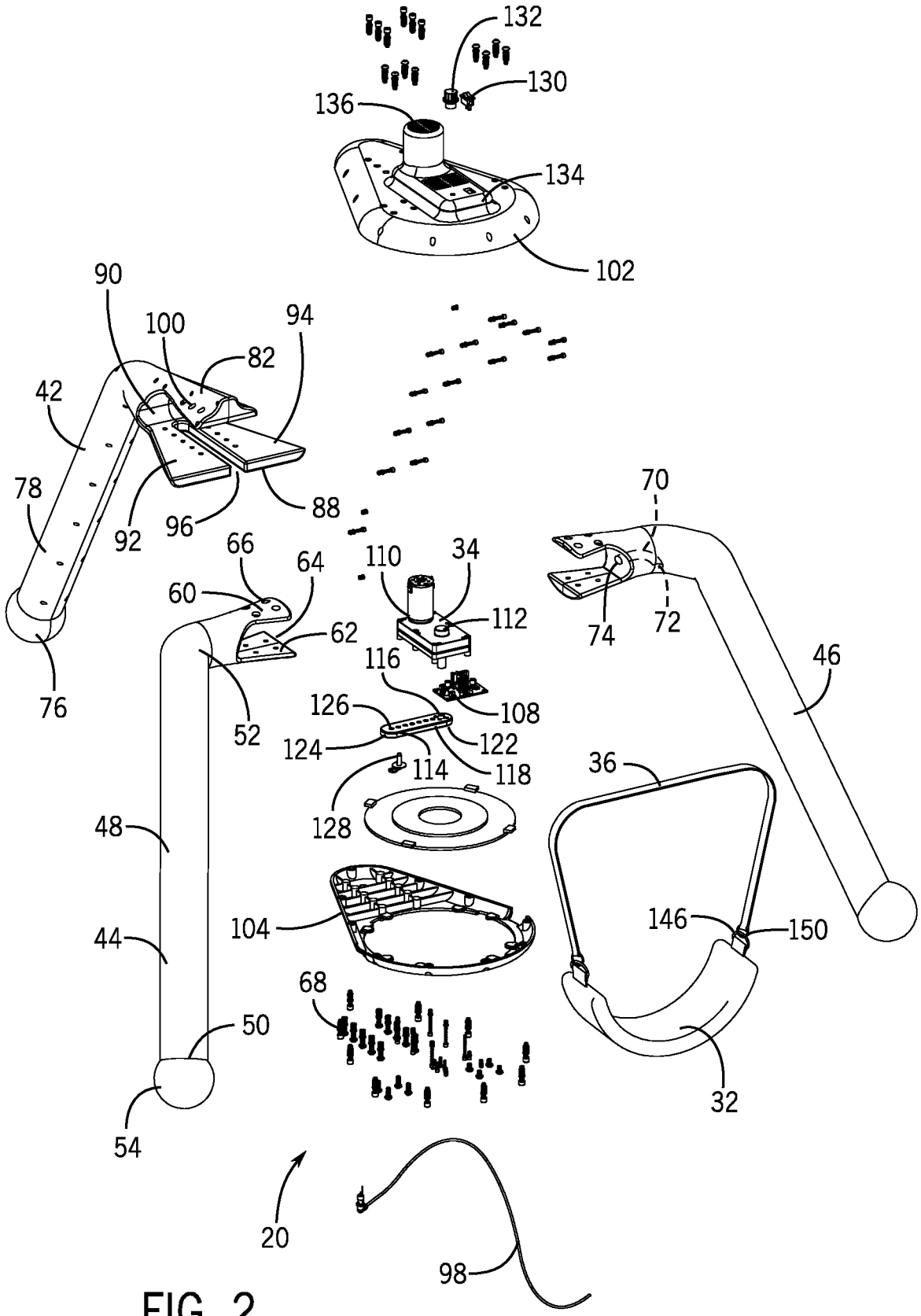
FIG. 2 is an exploded isometric view of the therapy device of FIG. 1.
Figure 3:
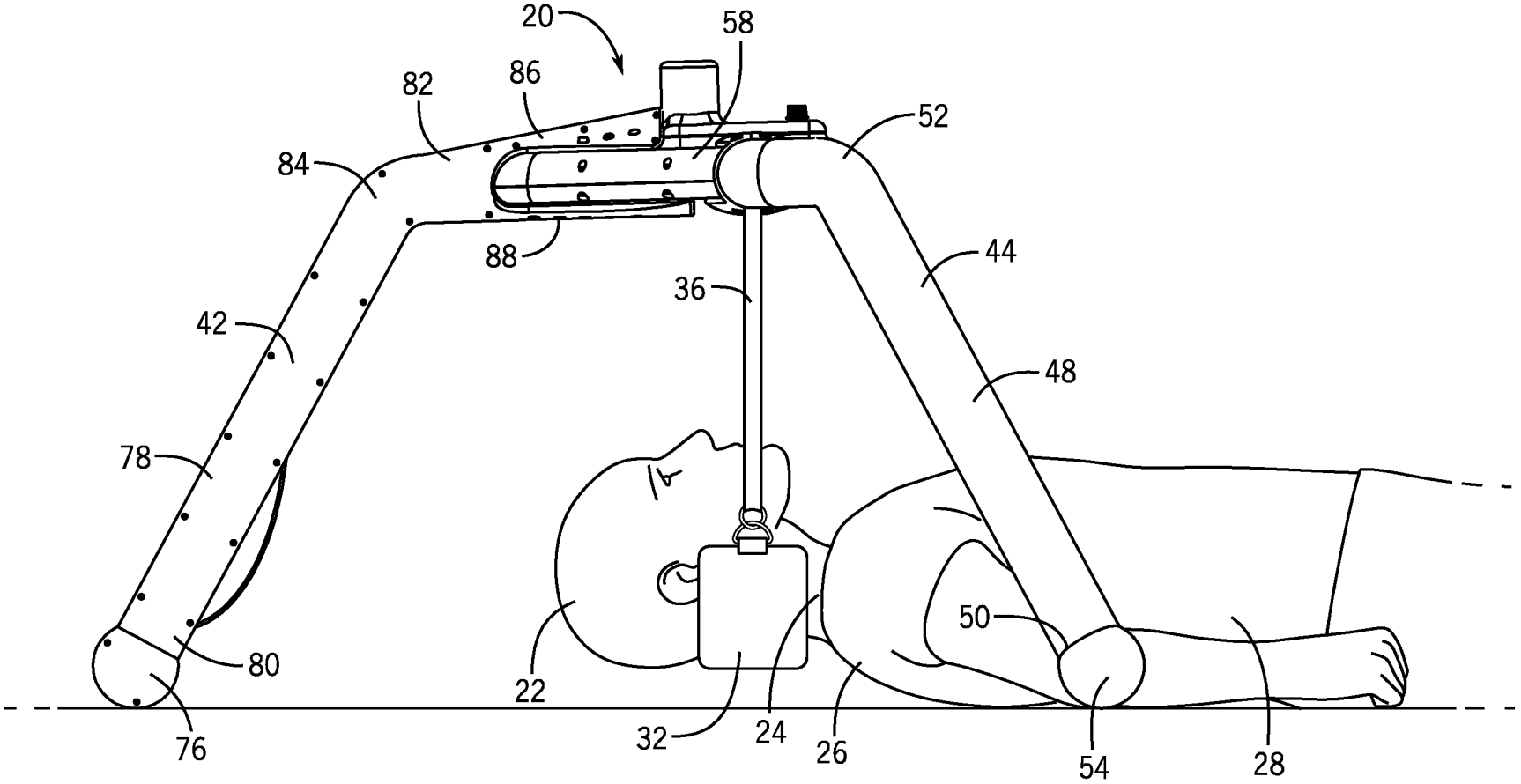
FIG. 3 is a side elevation of the therapy device of FIGS. 1 and 2 where a user's neck is supported by a sling associated with the therapy device.

A wide variety of different therapy devices that provide passive rotational motion to a supine user's head and neck could be constructed in accordance with the invention as defined by the claims. Hence, while exemplary embodiments of the invention will now be described, it should be understood that the invention is in no way limited to any of the described embodiments.

Turning initially to FIGS. 1-7, a therapy device 20 is provided that is configured to provide for continuous passive rotational motion of a head 22, neck 24, and cervical spine 26 of a user 28. To achieve these results, the therapy device 20 includes a frame 30, a sling 32, and a motor 34. The motor 34 is configured to drive the sling 32 to result in the rotation of the user's head 22, neck 24, and cervical spine 26. A strap 36 may be attached to a first end 38 of the sling 32 and a second end 40 of the sling 32, where the strap 36 is manipulated to move the sling 32 to result in the continuous passive rotational motion of the user's head 22, neck 24, and cervical spine 26.

Still looking to FIGS. 1-7, the frame 30 is configured to support the motor 34, as well as some or all of the weight of the user's head 22, and part of the weight of the user's spine 26 when the user 28 rests his or her neck 24 on the sling 32. To do so, the frame 30 includes a plurality of legs that extend downwardly to a ground surface. In the illustrated embodiment, the frame 30 includes three legs 42, 44, 46 that extend downwardly to the ground surface, where the spacing of the legs 42, 44, 46 results in a Y-shaped frame when looking from a top plan view. Of course, the frame 30 can include additional or fewer legs, and the legs could also be spaced from one another at different angles as desired, for instance to result in a T-shaped frame, an X-shaped frame, or the like. Additional legs, beams, and the like may be provided to improve stability, durability, and functionality of the device 20. While the illustrated version shows housing and the motor located above the ground, the overall configuration of the device 20, and more specifically the frame, could be inverted, where the housing and the motor are located at the bottom beneath the user's head, with frame elements extending upwardly therefrom to allow the sling to hang downwardly from a higher point.

The frame 30 includes a rear leg 42, and first and second front legs 44, 46 to result in the Y shape. The first and second front legs 44, 46 are substantially similar to one another, such that only the first front leg 44 will be described herein. The front leg 44 includes an upright member 48 having a first end 50 and a second end 52, a foot 54, and a mounting section 56. The foot 54 is located at the first end 50 of the upright member 48, and the mounting section 56 extends from the second end 52 of the upright member 48. The mounting section 56 may be formed with the upright member 48, or it may be a separate piece that can be slid into the second end 52 or the upright member 48. Where the components are separate, the mounting section 56 may be secured to the upright member 48 using various bolts, screws, magnets, snap-fits, clips, etc. The foot 54 is configured to rest upon the ground and prevent unintentional lateral movement of the leg 44, and by extension, the frame 30 as a whole. The mounting section 56 may be secured to a housing 58 of the frame 30, which will further be described below. The mounting section 56 is configured to be securely connected to the housing 58 regardless of the orientation, dimensions, and shape of the legs 44, 46 and the housing 58. As shown, the mounting section 56 extends substantially horizontally from the second end 52 of the upright member 48. The illustrated mounting section 56 is substantially "C" shaped when viewed from a side cross section, with an upper mounting surface 60, a lower mounting surface 62, and an opening 64 formed therein. The upper mounting surface 60 and the lower mounting surface 62 are substantially rectangular in shape. The shape of the opening 64 is configured to allow the housing 58 to be mounted within the opening 64 in a flush manner to ensure that the frame 30 is structurally sound. Holes 66 are formed in the upper mounting surface 60 and the lower mounting surface 62 to enable screws, bolts, or other fasteners 68 to be inserted therein to secure the leg 44 in place relative to the housing 58. Of course, the legs could similarly be mounted to the housing using other suitable ways as known in the art, including a snap-fit, clip, magnet, or other connection.

Additionally, a channel 70 may be formed in a portion of the front legs 44, 46, including the upright member 48, as well as the mounting section 56, that accommodates a portion of the sling 32 or the strap 36 attached thereto. For instance, the upright member 48 may have a first opening 72 associated with the channel 70 that is formed in the upright member 48. A second opening 74 may be formed in the mounting section 56, with the channel 70 extending from the first opening 72 to the second opening 74. In this way, the strap 36 may be fed through the upright member 48 in each respective front leg 44, 46 and threaded through the mounting section 56 into the housing 58. This allows the strap 36 to be moved within the housing 58 to enable rotational movement of the sling 32 to result in side-to-side movement of the user's head 22 and neck 24 as will be further described below.

The rear leg 42 has many of the same features as described above for the front legs 44, 46, including a foot 76, an upright member 78 extending from the foot 76 at a first end 80, and a mounting section 82 extending from a second end 84 of the upright member 78. Because only one rear leg 42 is provided and two front legs 44, 46 are provided, the upright member 78 may have a greater slope and length to support the back half of the device 20. Similarly, the mounting section 82 may have a more extended, robust design since the rear leg 42 is responsible for supporting the back half of the device 20. As shown, the mounting section 82 is still substantially "C" shaped when viewed from a side cross section. Again, the mounting section 82 has a top mounting surface 86, a lower mounting surface 88, and an opening 90 formed therebetween. As shown, the lower mounting surface 88 may have first and second lower mounting surfaces 92, 94 with a slit 96 formed therein. The slit 96 may be formed to allow a power cord 98 to extend from the housing 58 to a power supply. The opening 90 of the mounting section 82 is specifically dimensioned to accommodate the shape of the rear end of the housing 58 such that the housing 58 can be aligned within the mounting section 82 to result in a flush connection of the housing 58 and the rear leg 42. Again, holes 100 are formed in the top mounting surface 86, as well as the first and second lower mounting surfaces 92, 94 to accommodate screws, bolts, or other fasteners. Otherwise, the rear mounting leg 42 can be mounted to the housing 58 using other suitable ways as known in the art, including a snap-fit, clip, magnet, or other connection.

The first front leg 44 is laterally offset from the second front leg 46, and the rear leg 42 is longitudinally offset from the front legs 44, 46. The configuration of the legs 42, 44, 46 therefore provide clearance for the user's head 22 when the user 28 places his or her neck 24 onto the sling 32. The feet 54, 76 of the legs 42, 44, 46 provide sufficient surface area in contact with the ground surface such that the frame 30 remains balanced in place and does not fall over when the device 20 is in use. Additionally, the legs 42, 44, 46 in combination with the housing 58 provide structural rigidity in order to support the user's head 22 and neck 24 during use.

As shown in FIGS. 1-7, the housing 58 is a central housing located at the center of the frame 30. The housing 58 includes a top panel 102 and a bottom panel 104 that can be attached to one another when the appropriate components are mounted therein. For instance, the top panel 102 and the bottom panel 104 may include holes 106 formed therein, as shown, configured to receive bolts or screws to secure the panels 102, 104 together. Alternatively, the panels 102, 104 may include snap-fits, clips, magnets, or other fasteners to secure the top panel 102 to the bottom panel 104. The bottom panel 104 includes an opening 105 in which a disk 107 is received. As shown, the housing 58 is substantially tear-shaped. The housing 58 could similarly take any other number of shapes, including a circular-shaped, square-shaped, rectangular-shaped, or triangle-shaped housing. The panels 102, 104 may include additional features to accommodate the various components housed within. For instance, an access cover (not shown) may be formed in the top or bottom panel 102, 104 to allow a user to access the interior of the housing 58.

The housing 58 is configured to contain a number of components therein. More specifically, the housing 58 is configured to include a number of electronic components, as well as mechanical components, responsible for movement of the sling 32. As shown, the motor 34 and a printed circuit board 108 are contained within the housing 58. The motor 34 is a traditional gear motor that includes a gear box 110 and a rotatable shaft 112 that extends therefrom. The printed circuit board 108 is coupled to the motor 34, as well as controls that will be further described below, to enable control of the motor 34 based on input from the user 28. Additionally, the power cord 98 is attached to the circuit board 108 and may extend from the housing 58 and connect to a power outlet (not shown) located in close proximity to the device 20. For instance, depending on a number of factors including the dimensions of the frame 30 and the weight of the supported load including the user's head 22 and neck 24, the desired speed, and the desired amount of rotation, the power cord 98 may supply the motor 34 with 12-24 volts of power. While the illustrated embodiments show devices having a single motor, it should be known that multiple AC or DC motors can similarly be used to achieve the desired rotation of the user's head 22, neck 24, and spine 26. Otherwise, the motor 34 may be battery powered.

The housing 58 also contains an armature 114. The armature 114 is the component that actually facilitates the movement of the sling 32 by manipulation of the strap 36. The illustrated armature 114 is substantially cylindrical in shape and includes a base opening 116 that mounts to the motor 34 and a lateral arm 118 that extends from the base 116. More specifically, the base opening 116 is sized to receive the rotatable shaft 112 of the motor 34. Thus, when power is supplied to the motor 34, rotation of the shaft 112 occurs which results in rotation of the armature 114. In the illustrated embodiment, the armature 114 may be between 0.25-2 inches in width at the base 116, and more preferably between 0.5-1 inches wide at the base 116. Additionally, the overall length of the armature 114 may be between 3-8 inches, and more preferably between 5-6 inches. Of course, the armature 114 may take a number of other shapes and configurations, include a wedge, a bar, a rectangle, a cylinder, a circle, or the like.

Additionally, the lateral arm 118 has a plurality of openings or attachment points 126 formed therein. Each of these attachment points 126 are configured to receive a sling lead 128 that attaches to the strap 36. The sling lead 128 may be removably inserted into any of the attachment points 126, for instance using a threaded fit or snap fit. Depending on the attachment point 126 that the sling lead 128 is inserted into, the rotational limits of the travel path of the sling 32 can be determined. For instance, if the sling lead 128 is inserted into the innermost attachment point 126*a* located directly next to the base 116, the degree of rotation will be the smallest. This occurs because the overall travel path of the strap 36 is minimized, which in turn minimizes the path of rotation. To the contrary, if the sling lead 128 is inserted into the outermost attachment point 126*g* located at the second end 124 of the lateral arm 118, the degree of rotation will be greatest. Because the overall travel path of the strap 36 is maximized when the outermost attachment point 126*g* is used, the path of rotation is also maximized.

Figure 4:
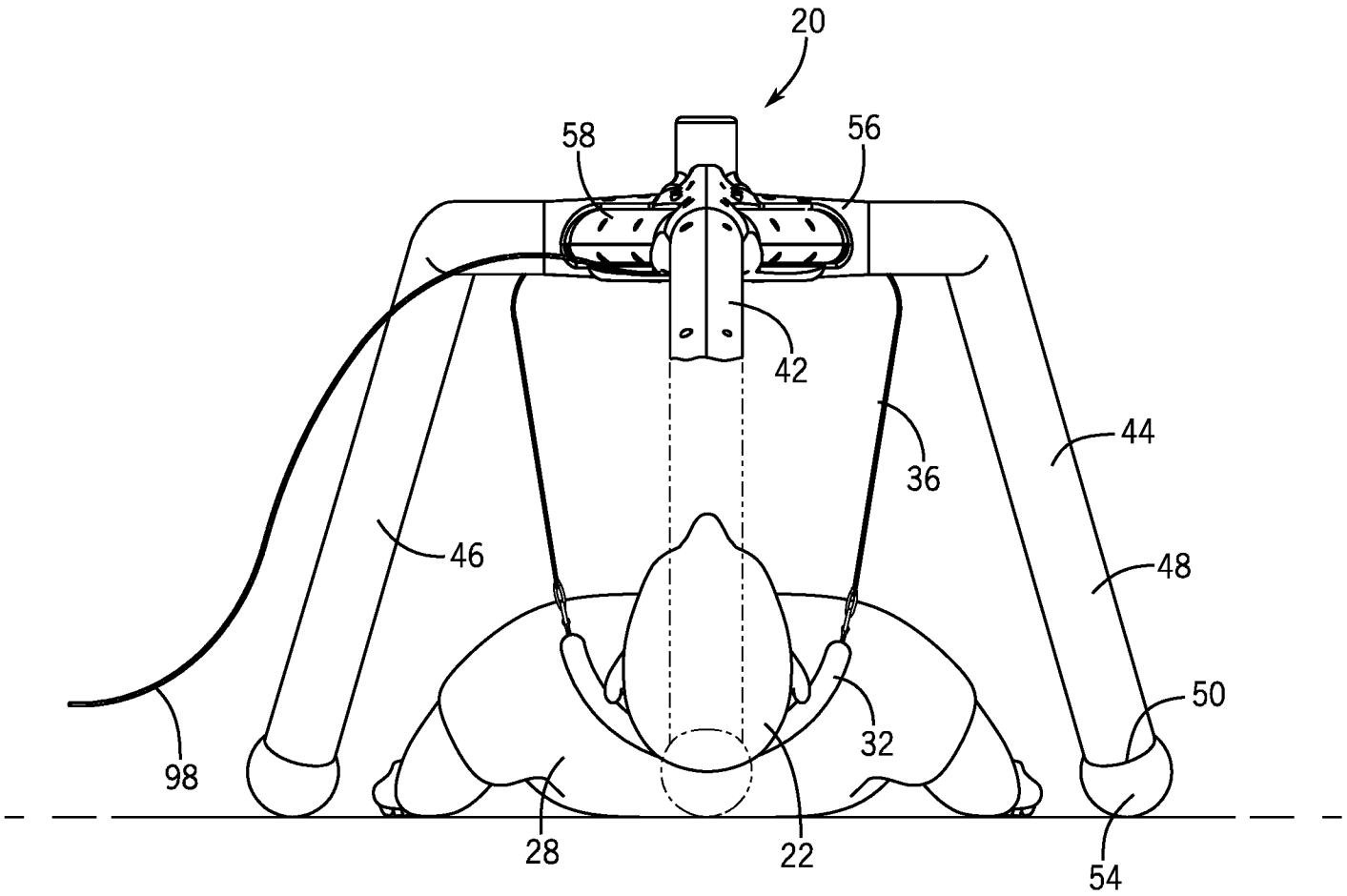
FIG. 4 is a rear elevation view of the therapy device of FIGS. 1-3 where the user's neck is supported by the sling in a first position where the user's face is pointing directly upwardly.

As shown, the lateral arm 118 includes seven attachment points 126. In this configuration, where the sling lead 128 is inserted into the innermost attachment point 126*a*, the total degree of rotation is 60 degrees, with rotation of a user's head 22 and neck 24 being 30 degrees in either direction from an initial position where the patient's head 22 faces directly upwardly as shown in FIG. 4. Where the sling lead 128 is inserted into the outermost attachment point 126*g*, the total degree of rotation is 180 degrees, with rotation of a user's head 22 and neck 24 being 90 degrees in either direction from the initial position. In the current embodiment, the degree of rotation is increased 20 degrees for each hole outwardly from the base 116. More specifically, rotation using the second inner-most attachment point 126*b* will be 80 degrees, 40 in either direction; rotation using the third inner-most attachment point 126*c* will be 100 degrees, 50 in either direction; rotation using the fourth inner-most attachment point 126*d* will be 120 degrees, 60 degrees in either direction; rotation using the fifth inner-most attachment point 126*e* will be 140 degrees, 70 degrees in either direction; and rotation using the sixth inner-most attachment point 126*f* will be 160 degrees, 80 in either direction. In order to adjust the degree of rotation, the access cover formed in one of the panels 102, 104 may be opened. Of course, the degree of rotation can also fall outside of the described 60-180 degrees of rotation, as may be desired. Similarly, additional or fewer attachment points may be provided to enable varying degrees of rotation.

The panels 102, 104 may also have a variety of control switches mounted thereto and connected to the printed circuit board 108, including a power switch 130 to start operation of the motor 34, and by extension the device 20, and a speed dial 132 that allows a user 28 to adjust the speed of rotation to allow the user 28 to define desired operation parameters. Of course, both the power switch 130 and speed dial 132 need not be mounted directly onto the panel 102, 104, but instead could otherwise be associated with the device 20, for instance, on the power cord 98 that connects the motor 34 to a power source. The speed can be adjusted between 0-20 rotations per minute, and more preferably 0-12 rotations per minute, where each rotation means that a user's head 22 moves from the first position as shown in FIG. 4 all the way to the right, then all the way to the left, and then back to the right to the first position. Additionally, one or both of the panels 102, 104 may be molded to accommodate specific components. As shown the top panel 102 is molded to include a first substantially rectangular section 134, as well as a second substantially circular section 136, where the substantially rectangular section 134 is dimensioned to accommodate the gear box 110 and the substantially circular section 136 is dimensioned to accommodate the motor assembly 34.

Figure 6:
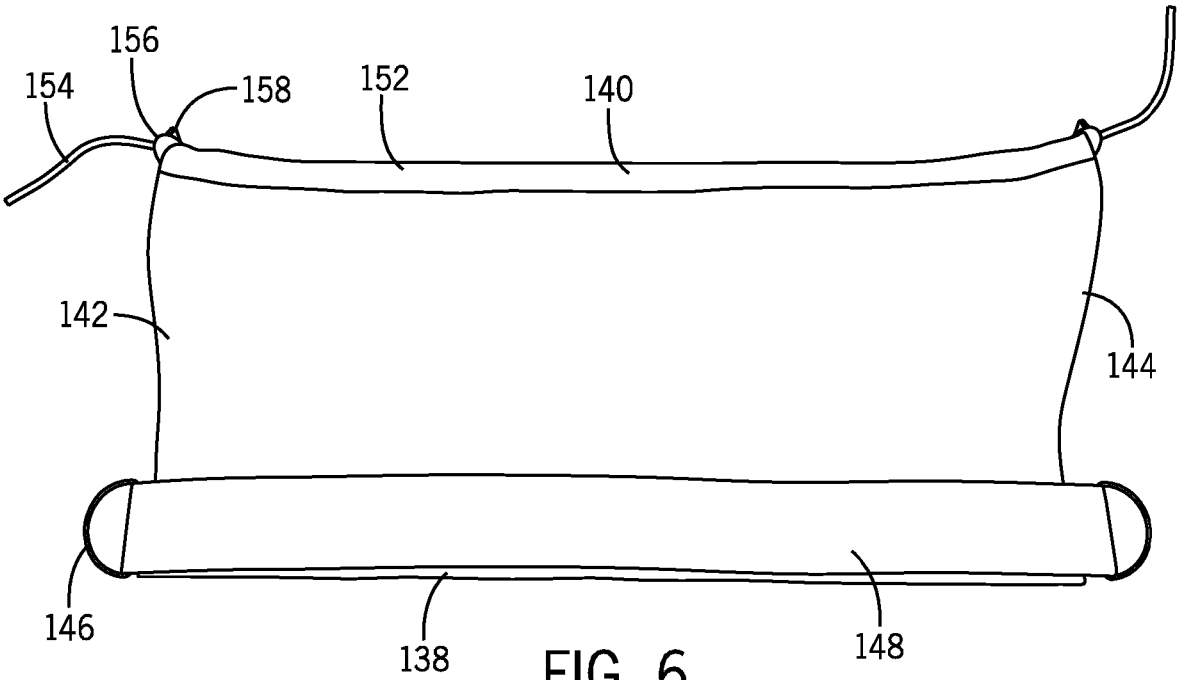
FIG. 6 is a top plan view of a sling used in with the therapy device of FIGS. 1-5 in a first position.
Figure 7:
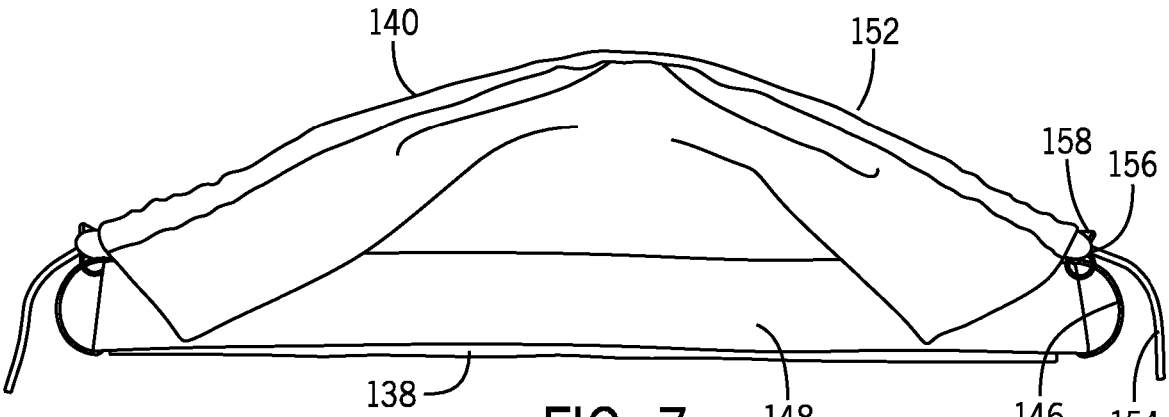
FIG. 7 is a top plan view of the sling of FIG. 6 in a second position.

Next, the sling 32 will be described with reference to FIGS. 6 and 7. A variety of different slings 32 can be used to improve the effectiveness of the device 20. The illustrated sling 32 is substantially rectangular in shape with a first side 138, a second side 140 opposite the first side 138, a first end 142, and a second end 144 opposite the first end 142. The sling 32 is made of a soft material, such as fabric, that is comfortable for a user 28 to rest his or her neck 24 and head 22 on. The sling 32 may include rings 146 or other openings at both ends 142, 144 directly adjacent to the first side 138. The rings 146 may be mounted directly to the sling 32, or they may be mounted to either end of a heavy-duty strap 148 that is inserted into the sling 32 along the length of the first side 138. For instance, the heavy-duty strap 148 may be between 1-3 inches, and more preferably 2 inches in width, and between 15-30 inches, and more preferably 22 inches in length. This heavy-duty strap 148 may serve as the primary support for the user's head 22 and neck 24, with the additional material serving as a secondary support. The rings 146 are configured to allow the strap 36 to be secured to the sling 32. For instance, the strap 36 may include hooks 150 that can be secured to the rings 146. In doing so, the sling 32 may be removed from the device 20 when the device 20 is not in use, while the strap 36 may remain affixed to the sling lead 128.

Additionally, the sling 32 may include a channel 152 that is formed along the entire second side 140 of the sling 32. An elastic band 154, drawstring, or the like may be threaded into the channel 152, with clamps 156 located at either end of the channel 152 adjacent to the first end 142 and the second end 144. For instance, the clamps 156 may be spring-loaded clamps that remain in a closed position unless a user asserts a force of a button 158 located on the clamp 156. The combination of the channel 152, the elastic band 154, and the clamps 156 allow the overall length of the second side 140, as well as the width of the first end 142 and the second end 144, to be manipulated. For instance, as shown in FIG. 6 the sling 32 is shown in an initial position, where the elastic band 154 has not been manipulated. In this configuration, the sling 32 is in a fully-extended position where the length of the second side 140 and the width of the first end 142 and the second end 144 are maximized. In the event that a user 28 wishes to adjust the dimensions of the sling 32, and more specifically reduce the width of the first end 142 and the second end 144, the clamps 156 can be moved along the elastic band 154 to cinch up the second side 140. For instance, as shown in FIG. 7 the second side 140 curves toward the first side 138. Additionally, the clamps 156 can further be attached to the rings 146. In this way, the sling 32 can be converted from a substantially flat rectangular to a curved cradle that more comfortably receives a user's head 22. Depending of the amount of support desired, the user 28 can manipulate these clamps 156 and the elastic band 154. The sling 32 may be adjustable in additional ways, which would allow the same therapy device 20 to be customized to a given user 28 based on the user's body, as well as desired characteristics such as degree and speed of rotation and most notably degree of neck extension.

In the illustrated embodiments, the overall length of the sling 32 could be between 10-45 inches, and more specifically between 15-36 inches to allow for full rotation of the user's head 22. For instance, the sling 32 shown in FIGS. 6 and 7 is approximately 22 inches in length. The width of the sling 32 could similarly be varied, for instance, between 2-20 inches, and more typically between 8-14 inches. As shown in FIGS. 6 and 7, the sling 32 is approximately 11 inches in width. Additionally, the sling 32 could be made of a variety of different fabrics and materials, including memory foam, and a gel-filled cloth. The sling 32 may be made of a washable material or the sling 21 may be disposable such that the device 20 can be used by multiple users while maintaining sanitary conditions. While the illustrated sling 32 is made of a substantially flat piece of material until the clamps 156 and elastic band 154 are manipulated, it could also be more cylindrical or curved in shape, which could help to ensure that traction and extension occur. Additionally, the sling 32 may be of a multiple-piece construction (not shown), with a first component (not shown) that specifically supports the neck 24, while another portion (not shown) cradles the head 22. Further still, the sling 32 may include a heated component (not shown) to further improve the experience of using the device 20.

As shown, the sling 32 is elevated off of the surface that supports the device 20, for instance, by 1.0-8.0 inches and more typically between 3.0 and 6.0 inches. Of course, the elevation between the sling 32 and support surface could further be varied depending on user preference by adjusting the length of the sling 32, the length of the strap 36, and the dimensions of the legs 42, 44, 46.

Depending on where the user 28 rests his or her head 22 or neck 24 on the sling 32, the user's head 22 will extend beyond the front of the sling 32, resulting in the head 22 being positioned at a slightly downwardly angle relative to the user's neck 24, as shown in FIG. 1. This can allow the user's spine 26 to be put in axial traction due to the gravitational forces exerted by placing the neck 24 in the sling 32 with the head 22 hanging over the back of the sling 32. Further, the act of hanging the head 22 uses the weight of the head 22 to place the user's neck 24 in extension. Therefore, where a user 28 positions the sling 32 to primarily support his or her neck 24, a greater amount of extension and a greater amount of axial traction force occurs. To the contrary, where the user 28 positions the sling 32 to primarily support his or her head 22, a reduced amount of extension and axial traction occurs. By way of example, depending on where the sling 32 is located relative to the user's head 22 and spine 26, 0-20 pounds of gentle axial traction, and more particularly 5-15 pounds of gentle axial traction can occur. In doing so, ideal cervical curve posture is achieved, which further improves the effectiveness of the continuous passive motion rotation.

The strap 36 may be made of any variety of flexible materials with negligible stretch, such as a cable, a rope, a string, or a ribbon. The strap 36 is fed through the openings 72 of the upright member 48, through the channels 70, and out the openings 74 into the housing 58. Within the housing 58, the strap 36 is affixed to the sling lead 128. As a result, as the armature 114 rotates once the motor 34 is powered on, the strap 36 travels with the sling lead 128 to result in movement of the first end 38 and the second end 40 in upward and downward directions. While the strap 36 travels along the channels 70 the sling 32 is rotated from side to side, which in turn rotates a user's head 22, neck 24, and cervical spine 26 when in use.

Figure 5:
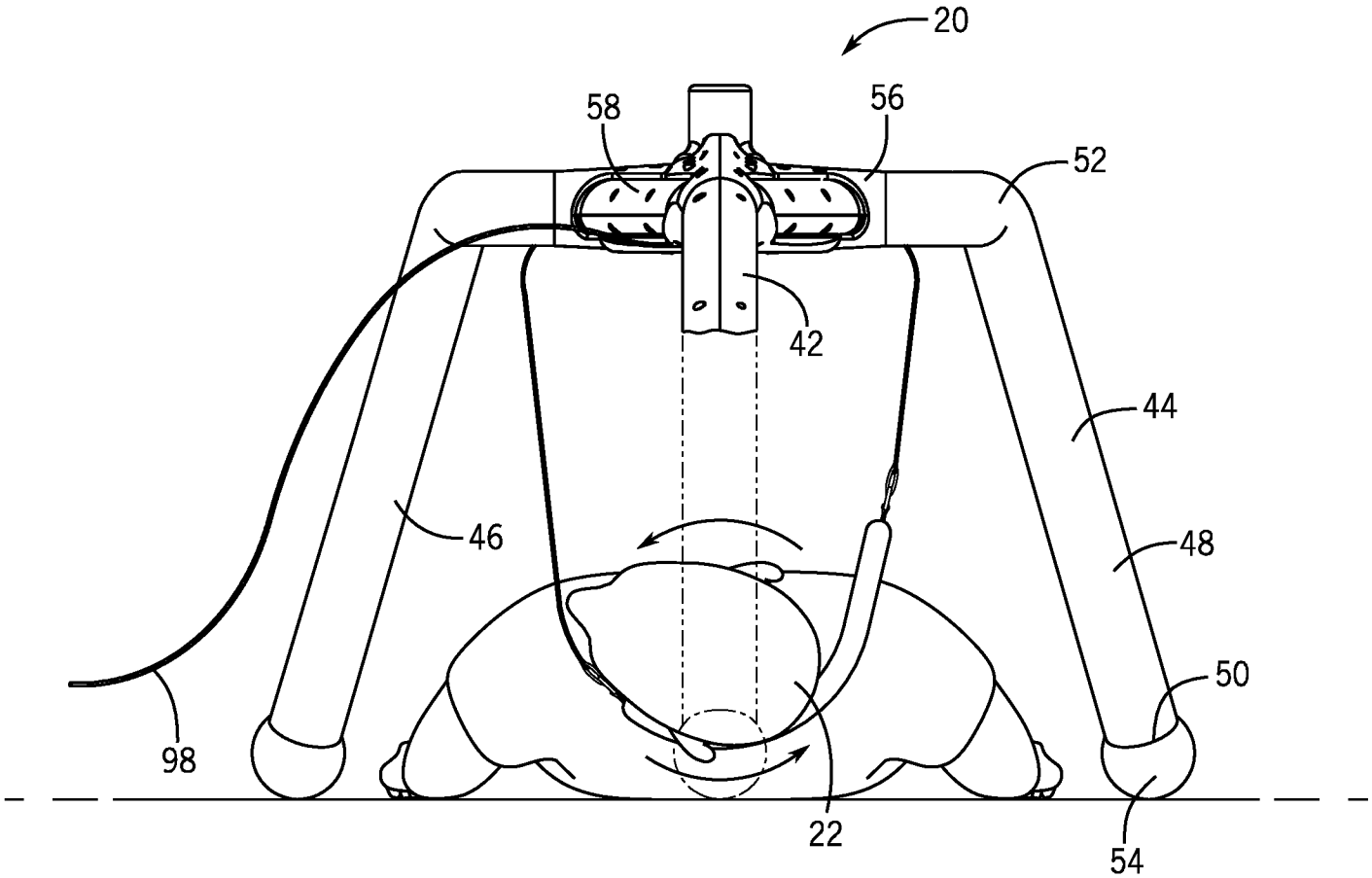
FIG. 5 is a rear elevation view of the therapy device of FIGS. 1-4 where the user's neck is rotated to a second position where the user's face is pointed to the left.

Operation of the device 20 will now be described. First, a user 28 selects a desired amount of rotation by inserting a sling lead 128 into a desired attachment point 126. Next, a user 28 rests his or her neck 24 on the sling 32. Once comfortably located, the user 28 may manipulate the power switch 130 as well as the speed dial 132. As the sling 32 is moved relative to the frame 30, the user's head 22, neck 24, and spine 26, are rotated from side to side, as shown in FIGS. 4 and 5. For instance, the user's head 22, neck 24, and spine 26 are rotated in a first direction in FIG. 5, with the right side of the sling 32 moving upwardly and the left side moving downwardly, and then in a second direction opposite what is shown in FIG. 5, with the right side of the sling 32 moving downwardly and the left side moving upwardly. The extent of rotation can be varied depending on the preferences of any given user 28 by inserting the sling lead 128 into a given attachment point 126. For instance, rotation of 30 degrees up through rotation of 180 degrees are oftentimes desired. Similarly, the speed of rotation can again be varied to meet the desired preference of a given user 28. The length of a given cycle of the device 20 could be between 2-30 seconds, and more particularly between 4-20 seconds. As a result, a user's cervical spine 26 can be passively moved through a full range of motion while the spine 26 is also comfortably supported when the neck 24 is in extension.

Figure 8:
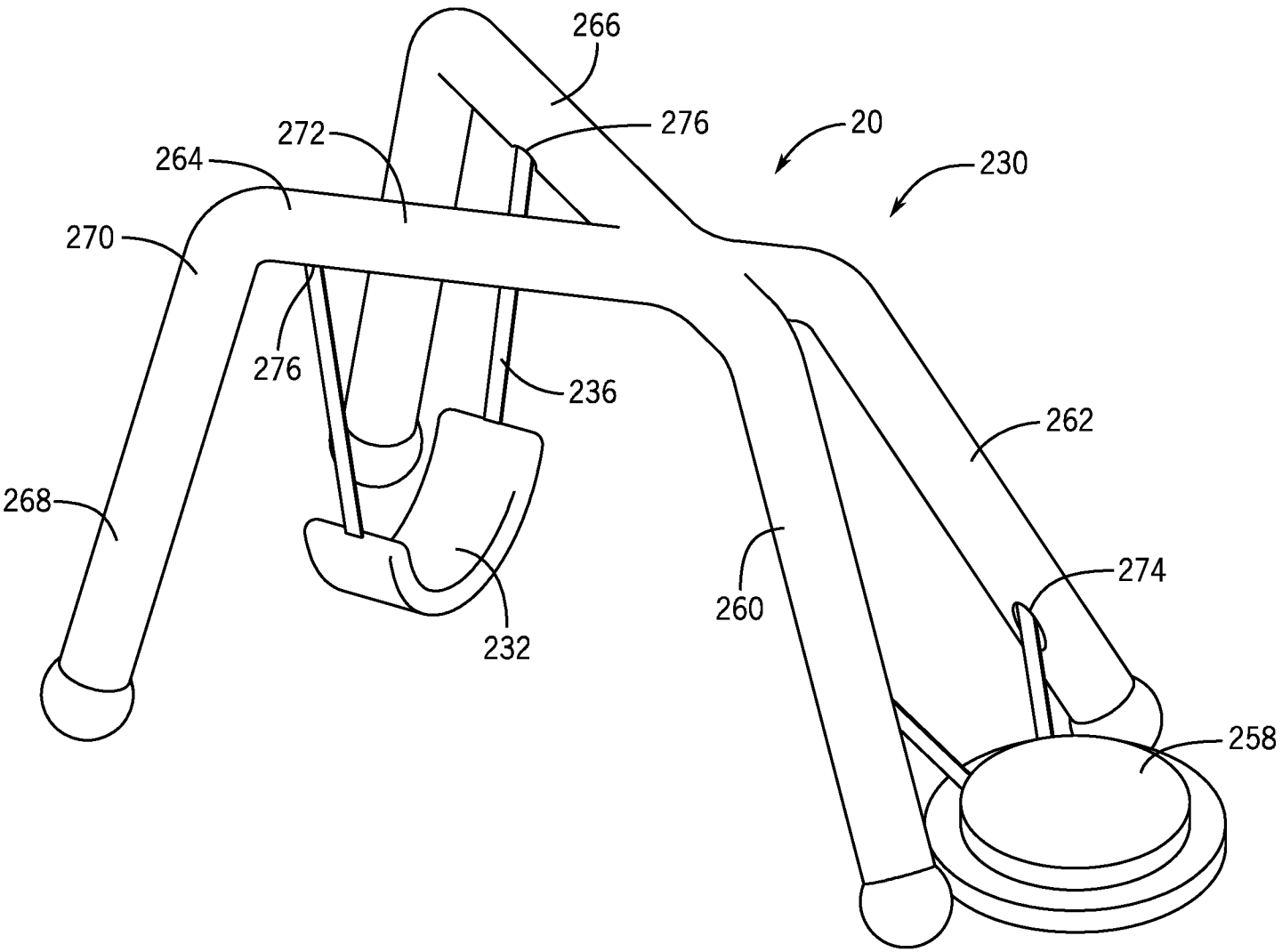
FIG. 8 is an isometric view of another embodiment of a therapy device for a neck and spine that rotates a user's head from side to side.

Another embodiment including many of the same components is shown in FIG. 8. The previously-described components of FIGS. 1-7 will be designated by the same reference characters incremented by 200. Here, the frame 230 includes additional components. The frame 230 includes first and second rear legs 260, 262 and first and second front legs 264, 266. As shown, the frame 230 is substantially X-shaped when viewed from a top plan view. Each of the legs 260, 262, 264, 266 may be formed together, or each may be formed separately and mounted together using an X-shaped joint (not shown). The rear legs 260, 262 are substantially straight in shape and angled upwardly. The front legs 264, 266 include a upwardly-extending section 268, an elbow joint 270, and a horizontally-extending section 272. In this embodiment, the rear legs 260, 262 may be substantially hollow and include openings 274 formed therein. Additionally, the front legs may be substantially hollow, at least along the horizontally-extending section 272. Furthermore, openings 276 are formed into the horizontally-extending section 272, as shown facing downwardly adjacent to the elbows 270. The housing 258, which encloses the motor (not shown), armature (not shown), sling lead (not shown), and portion of the strap, is mounted to the rear legs 260, 262 and rests upon the ground.

The strap 236 extends from the housing 258, through the openings 274 formed in the rear legs 260, 262, through the front legs 264, 266, and out of the openings 276 formed in the horizontally-extending section 272. Either end of the strap 236 fall downwardly out of the openings 276 formed in the horizontally-extending section 272. The sling 232 is attached to either end of the strap 236. As a result, as the armature rotates within the housing 258, the strap 236 moves in either direction to result in the rotational movement of the sling.

Figure 9:
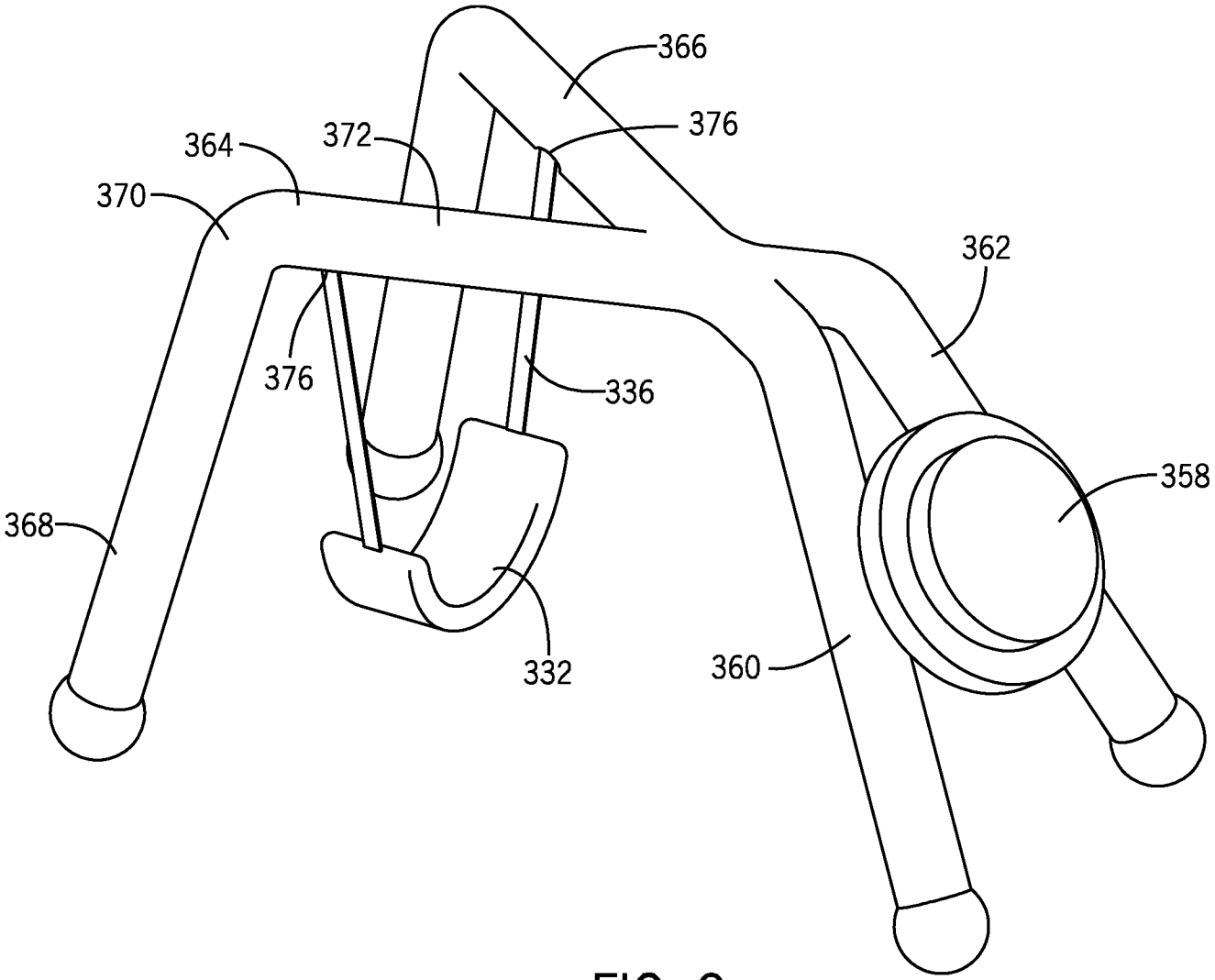
FIG. 9 is an isometric view of another embodiment of a therapy device for a neck and spine that rotates a user's head from side to side.

Turning next to FIG. 9, another embodiment is shown that functions substantially similarly to that of the embodiment shown in FIG. 8. The previously described components of FIGS. 1-7 will be incremented by 300, whereas the components described in FIG. 8 will be incremented by 100. In this embodiment, the housing 358 is mounted to the back the rear legs 360, 362. As a result, the housing 358 is located at an angle relative to the ground. Again, the strap 336 is routed from the housing 358, through the openings 374 in the rear legs 360, 362, the through channel 370 formed in the front legs 364, 366, and out the openings 376 formed in the front legs 364, 366. Once the motor (not shown) is activated, the armature (not shown) is rotated, which in turn rotates the sling lead (not shown). As a result, while the sling lead moves around the motor, the first end of the strap 336 moves upwards while the second end of the strap moves downwards, after which the first end of the strap 336 moves downwards and the second end of the strap moves upwards. In turn, either end of the sling 332 are similarly moved upwardly and downwardly.

Figure 10:
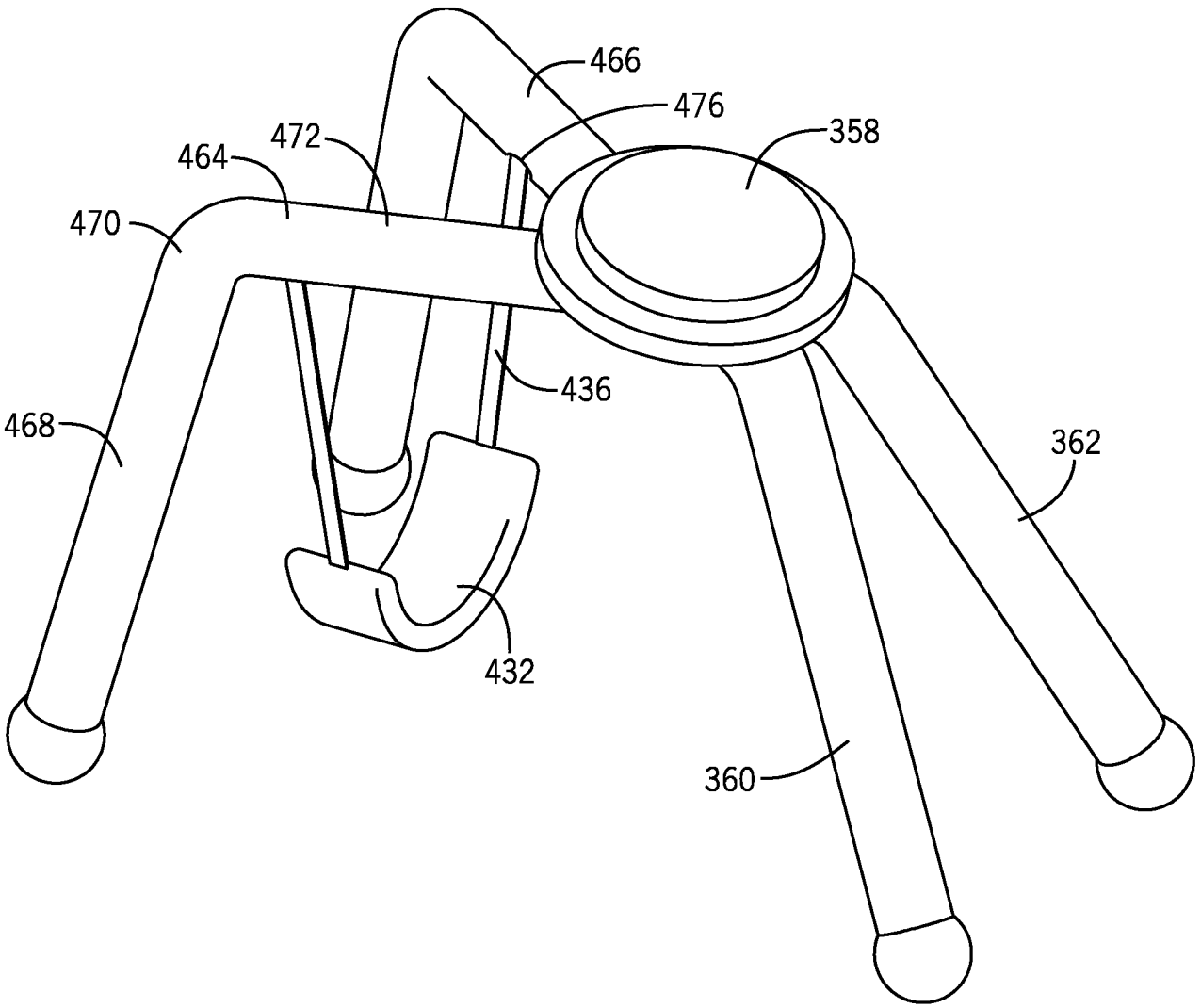
FIG. 10 is an isometric view of another embodiment of a therapy device for a neck and spine that rotates a user's head from side to side.

Turning next to FIG. 10, another embodiment is shown. The previously described components of FIGS. 1-7 will be incremented by 400, whereas the components described in FIG. 8. Will be incremented by 200. In this embodiment, the housing 458 is mounted to the top of the frame 430. In this embodiment, the strap 436 is routed from the housing 458, through the openings (not shown) in the front legs 464, 466, into the channel 470 formed therein, and out the opening 476 formed in the front legs 464, 466. Once the motor (not shown) is activated, the armature (not shown) is rotated, which in turn rotates the sling lead (not shown). As a result, while the sling lead moves around the motor, the first end of the strap 436 moves upwards while the second end of the strap 436 moves downwards, after which the first end of the strap 436 moves downwards and the second end of the strap 436 moves upwards. In turn, either end of the sling 432 is similarly moved upwardly and downwardly.

Additional alternative embodiments of the frame will now be described. Although the legs are shown as being fixedly molded in place, the legs can also be configured to be folded or collapsed to reduce the overall size or footprint of the frame in order to easily transport the device from location to another. Further still, the various components of the frame may be telescopic to facilitate stowage and/or to provide for adjustable frame height. Additionally, as mentioned above the legs may be releasably attached to the housing, such as using snap-fits, clips, magnets, and the like, to enable a modular device that can be easily and quickly assembled or disassembled for a more portable device. Also, different legs may be provided depending on the needs of a particular user. For instance, legs having multiple lengths may be provided, as well as legs being configured to attach to the housing at different angles may be provided.

The various components of the frame may be made of plastic, such as injection-molded plastic, metal, or any number of different materials, as long as the frame is durable and easily cleanable.

Of course, any component of the described embodiments could be combined with any of the other embodiments. Additionally, different chains, gears, straps, ropes, strings, shafts, and other mechanical components could similarly be used to achieve the desired side-to-side movement of a user's neck and spine. Further still, although the illustrated embodiments show the device resting on the ground, it should be noted that the devices could also be mounted to, or formed with, various pieces of furniture, such as a bed, for improved operational characteristics.

While specific materials have been discussed, it should be noted that the various components could be made of any suitable, durable materials, including but not limited to, plastic, stainless steel, other metals, and the like.

Additionally, it should be understood that the various inventive features described above can each be used independently of one another or in combination with other features.

Other embodiments and uses of the invention will be apparent to those skilled in the art from consideration from the specification and practice of the invention disclosed herein. It is understood that the invention is not confined to the specific materials, methods, formulations, operating/assay conditions, etc., herein illustrated and described, but embraces such modified forms thereof as come within the scope of the following claims.

What is claimed is:

1. A therapy device comprising:

a frame comprising:

a housing;

a first leg connected to the housing;

a second leg connected to the housing;

a channel extending from the first leg to the housing and through the second leg;

a sling configured to hold a neck and head portion of a supine user; and a motor held within the housing that drives the sling to move relative to the frame in a reciprocating manner in which opposite ends of the sling move oppositely one another;

an armature located within the housing that is connected to a rotational shaft of the motor;

a plurality of openings formed in the armature;

a sling lead releasably insertable into the at least two openings; and a strap connected to the sling and attached to the sling lead;

wherein movement of the sling results in continuous passive motion rotation of the user's neck and cervical spine; and wherein the strap is fed though the channel into the housing.

2. The therapy device of claim 1, wherein the sling lead is insertable into a first opening to result in 60 degrees of rotation of the user's neck and spine;

wherein the sling lead is insertable into a second opening to result in 120 degrees of rotation of the user's neck and spine; and wherein the sling lead is insertable into a third opening to result in 180 degrees of rotation of the user's neck and spine.

* * * * *